US006119993A

United States Patent [19]

Youngblood et al.

[11] Patent Number: 6,119,993

[45] Date of Patent: Sep. 19, 2000

[54] CLIMBING ANCHORS

[76] Inventors: Gary S. Youngblood, 2819 N. 24th Place-rear, Phoenix, Ariz. 85008; Glen J. Baumgartner, 736 S. Parsell, Mesa, Ariz. 85202

[21] Appl. No.: 08/769,484

[22] Filed: Dec. 18, 1996

[51] Int. Cl.[7] ..... A47F 5/08

[52] U.S. Cl. ..... 248/231.9; 248/925

[58] Field of Search ..... 248/925, 231.9, 248/231.91; 482/37

[56] References Cited

U.S. PATENT DOCUMENTS

| | | | |
|---|---|---|---|
| 3,948,485 | 4/1976 | Chouinard et al. | 254/135 |
| 4,069,991 | 1/1978 | Saunders et al. | 248/317 X |
| 4,082,241 | 4/1978 | Burkey | 248/231.9 |
| 4,184,657 | 1/1980 | Jardine | 248/231.9 |
| 4,422,609 | 12/1983 | Vallance | 248/231.9 |
| 4,491,291 | 1/1985 | Ching | 248/231.9 |
| 4,572,464 | 2/1986 | Phillips | 248/231.9 |
| 4,643,377 | 2/1987 | Christianson | 248/231.9 |
| 4,643,378 | 2/1987 | Gutherie et al. | 248/231.9 |
| 4,712,754 | 12/1987 | Brodie | 248/231.9 |
| 4,715,568 | 12/1987 | Best, Jr. | 248/925 X |
| 4,834,327 | 5/1989 | Byrne | 248/231.9 |
| 4,923,160 | 5/1990 | Waggoner | 248/925 X |

FOREIGN PATENT DOCUMENTS

| | | | |
|---|---|---|---|
| 195654 | 9/1986 | European Pat. Off. | 248/925 |
| 3526402 | 2/1987 | Germany | 248/925 |

*Primary Examiner*—Ramon O. Ramirez
*Attorney, Agent, or Firm*—Ellis, Venable & Busam, LLP

[57] ABSTRACT

A passive mountaineering chock or stopper is provided and which comprises of a prismatoid body having a first skewed hexagonal base, a second, parallel hexagonal base, and six lateral trapezoidal faces forming three opposed pairs of faces, each face with one side lying in the first skewed hexagonal base and an opposite side on each trapezoidal face lying in the second skewed hexagonal base, where lengths of the sides of the skewed hexagonal base substantially obey the following relationship: a first side has a length, a fourth side opposite the first side is slightly larger than the first side, a third side, immediately adjacent to the fourth side, is the same length as the second side, a sixth side, opposite the third side and adjacent the first side is slightly longer than the third and fourth sides, a fifth side, immediately adjacent the sixth side is the same length as the sixth side, and a second side, opposite the fifth side and adjacent the first and third sides, is longer than the fifth and sixth sides; a cable with a first end and a second end; and at least one passageway in the prismatoid body connecting the first skewed hexagonal base to the second skewed hexagonal base and wherein at least one the cable ends are received within said pair of apertures.

17 Claims, 7 Drawing Sheets

PRIOR ART

CLIMBING ANCHORS

FIELD OF THE INVENTION

The field of the present invention relates to an apparatus for the mountaineering art, and more particularly to a novel design for a climbing anchor such as a chock or stopper.

BACKGROUND

There are a plethora of outdoor activities enjoyed by active individuals. Mountaineering is one of the outdoor activities that is growing in popularity. Mountaineering activities may be as simple as climbing a mountain trail, or it may be take more involved forms such as free climbing. When free climbing, mountaineers use a variety of mechanical aids, such as pitons, bolts, chocks and stoppers, for anchoring themselves to a rock wall and the for the attachment of slings and the like.

Pitons are probably the mechanical climbing aid best known to the public. Pitons are steel spike like anchors that are forcefully driven, or hammered, into cracks in the rock face. Likewise, bolts are also forcefully driven into the rock face. The use of both has fallen into disfavor during recent years due to an anti-defacement ethic developing among mountaineers, and other wilderness users.

The use of removable chocks for climbing has evolved to replace the destructive practice of climbing with pitons and bolts. Chocks are typically wedge shaped devices used to anchor loops of cable to the rock face. There are two classifications of chocks, passive chocks and active chocks. Active chocks are mechanical devices employing numerous moving parts, each acting in cooperation with each other, to achieve the anchoring function. Examples of active chocking devices may be seen in the following U.S. Pat. Nos. 4,184,657; 4,491,291; 4,572,464; 4,586,686; 4,643,377; 4,643,378; 4,712,754; 4,834,327; and 4,923,160.

Passive chocks do not have moving parts and are primarily wedges or cans with a variety of different shapes. The first passive chocks were created by taking a regularly shaped hexagonal machine nut and looping a rope through the opening in the hexagonal axis. Opposed faces on the hexagonal nut were then wedged, with a horizontal hexagonal axis, between opposite rock faces of a crack. Because these first hexagonal chocks had a regular hexagonal shape they were only useful in cracks with a limited width variation. A different regular hexagonal chock size was needed for each different crack size. In practice, a rock face has a variety of different crack sizes. Thus, in order to cover the various crack sizes, one would have to carry an enormous suit of regular hexagonal nuts, a different nut for each different crack size. This is extremely heavy and burdensome to the climber.

Another passive chock is a simple tapered rectangular chock. The tapered rectangular chock has first and second rectangular bases with four trapezoidal walls extending between equivalent sides of the first and second bases, respectively. The design of this chock overcomes, at least in part, one of the limitations of the regular hexagonal chock discussed above. Each tapered rectangular chock may be used for two different sized cracks. This reduces by half the number of chocks needed to cover the range of crack sizes found on an actual rock wall. Each different width of the tapered rectangular chock is accessible by a 90 degree vertical rotation. This device is designed to be used in a vertical orientation, one in which the rectangular bases are horizontal and the axis between bases is vertical.

Yet another passive chock is disclosed in U.S. Pat. No. 4,081,241, by Burkey, which teaches a truncated trigonal pyramid having two substantially parallel bases each with three sides of unequal length. Three trapezoidal walls extend between corresponding sides of the two parallel bases. This device is designed to be used for three different sized cracks, each different size is accessible only by horizontal rotation of the truncated pyramid. Therefore, this device is designed to be used in a horizontal orientation, one in which the triangular bases are vertical, similar to the orientation of the regular hexagonal chock.

Vallence teaches, in U.S. Pat. No. 4,422,607, another rectangularly shaped passive climbing chock. The chock of this patent has two different sized rectangular bases and four walls with trapezoidal outline extending between the equivalent sides of two bases. Two of the walls have a concave and a convex configuration, respectively. The remaining two walls of the chock may be substantially flat, or, they may also be concave and convex, respectively. Thus, although this chock is used in a vertical attitude, it only provides for, at most, two different widths or orientations for use.

U.S. Pat. No. 3,948,485, by Chouinard et al., discloses a novel device with an irregular hexagonal horizontal cross section. The irregular hexagonal cross section of this device consists of three sets of opposed sides, a first set in which the opposed sides are parallel to each other, and a second and third set of opposed sides in which, in each set, the opposed sides have a dihedral angle of 10 degrees. This device further includes two end faces which also have a dihedral angle of 10 degrees. It is important to note that the horizontal axis of this device can never intersect any plane containing any of the six sides of this irregular hexagonal device, i.e., the six sides of this device are parallel to the horizontal axis of the device. Therefore, the horizontal axis only intersects the two end faces. Finally, this device requires two spaced apart circular passageways which extend between the pair of parallel faces. These circular passageways receive a rope (or cable) sling to which mountaineering devices can be attached.

Weight placed on the attached rope of the Chouinard device produces a rotational force about the horizontal axis of the device, thus camming the device into place.

While the above passive chocks are useful in themselves and in combination with each other, there is still a great need for a passive chock which has more than two useful orientations accessible by vertical rotation of the device.

SUMMARY OF THE INVENTION

It is an object of the present invention to provide a passive chock which has more than two useful orientations accessible by vertical rotation of the device.

It is another object of the present invention to provide a passive chock which utilizes an irregular hexagonal vertical cross section to provide for three useful orientations accessible by vertical rotation of the device.

It is a further object of the present invention to provide a passive chock which has three useful vertical orientations and incorporates at least one vertical passageway for receiving a rope or cable.

It is yet another object of the present invention to provide a set of passive chocks which provides for a graduated series of wedge widths wherein each single chock of the set contains three descending widths, and wherein the next three descending widths are found on a next smaller chock.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF PREFERRED EMBODIMENTS

Figure 1C:
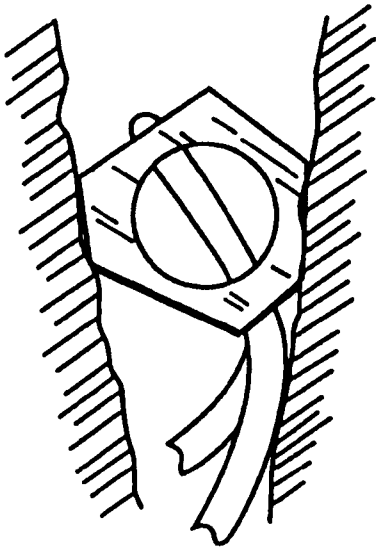
FIG. 1*c* illustrates a known two-fold passive horizontal chock.
Figure 1B:
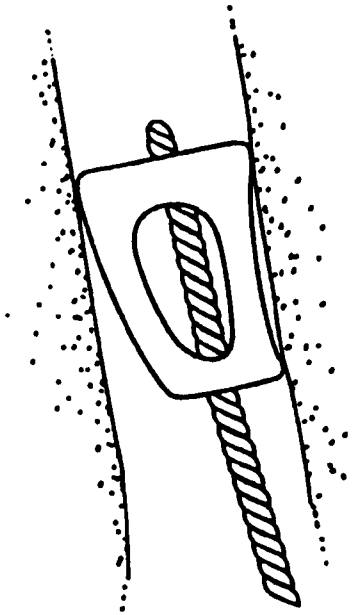
PRIOR ART Fig. 1b
FIG. 1*b* illustrates a known two-fold passive vertical chock.
Figure 1A:
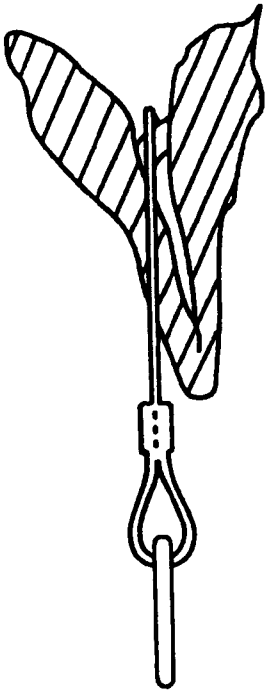
PRIOR ART Fig. 1a
FIG. 1*a* illustrates a known three-fold passive horizontal chock.
Figure 2:
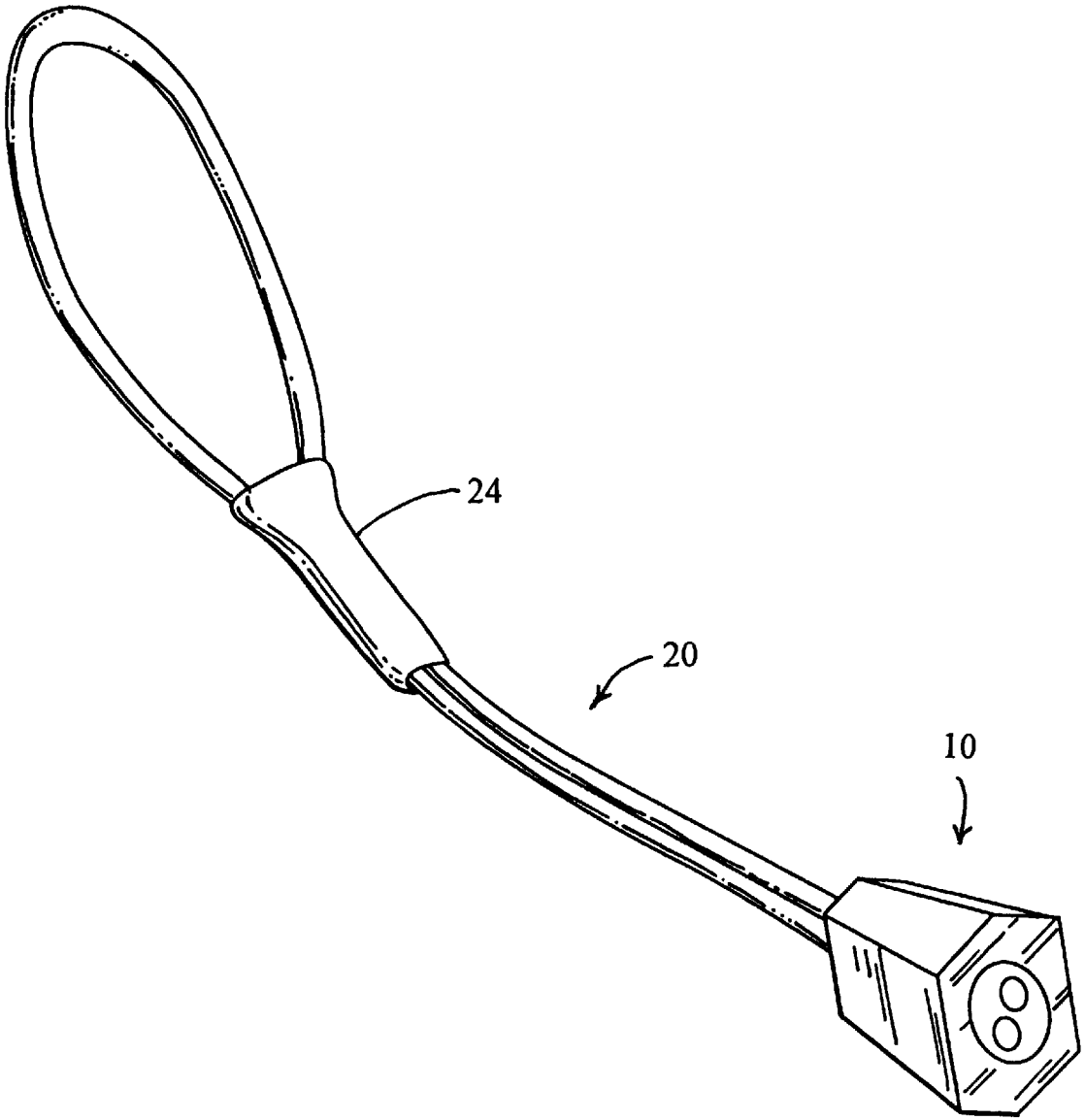
FIG. 2 is an illustration of one embodiment of the present invention.
Figure 3A:
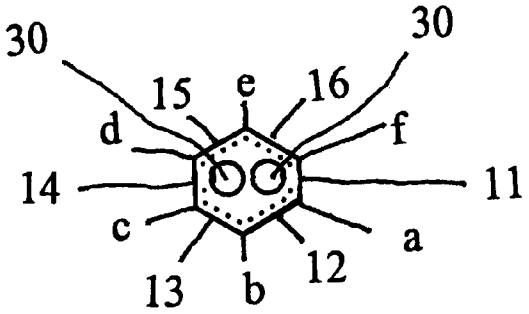
FIG. 3*a* shows a top view of the present invention, dotted lines in all views illustrate hidden lines.
Figure 3B:
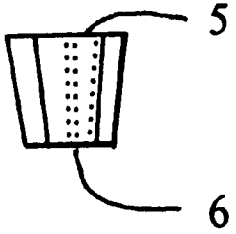
FIG. 3*b* shows a side view of the body of the present invention.
Figure 3C:
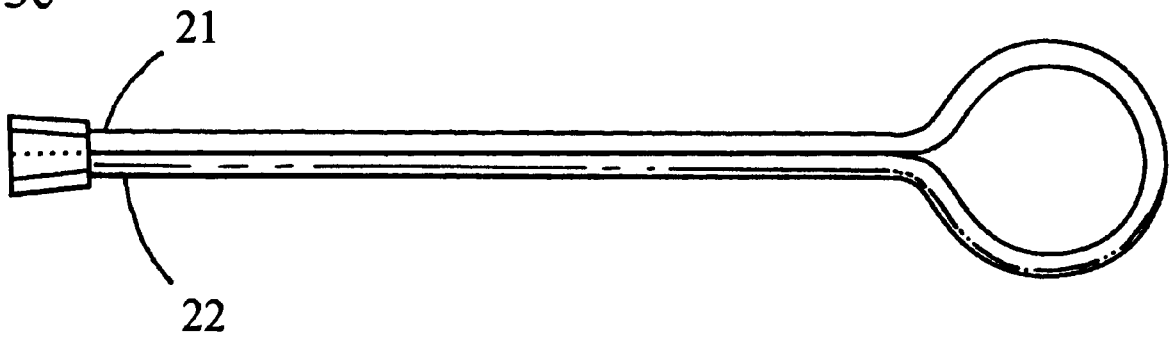
FIG. 3*c* shows the configuration of the present invention contemplated for smaller chocks, note the double cabling.
Figure 4A:
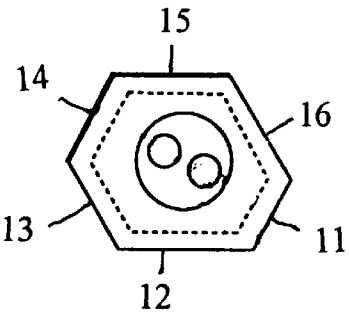
FIG. 4*a* shows a bottom view of a second embodiment of the present invention.
Figure 4B:
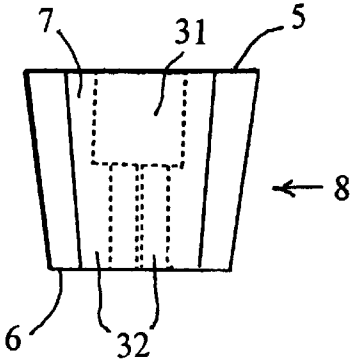
FIG. 4*b* shows a side view of the second embodiment of the present invention.
Figure 4D:
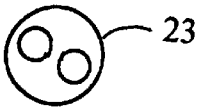
FIG. 4*d* shows an end view of the cable receiving insert of the present invention.
Figure 4C:
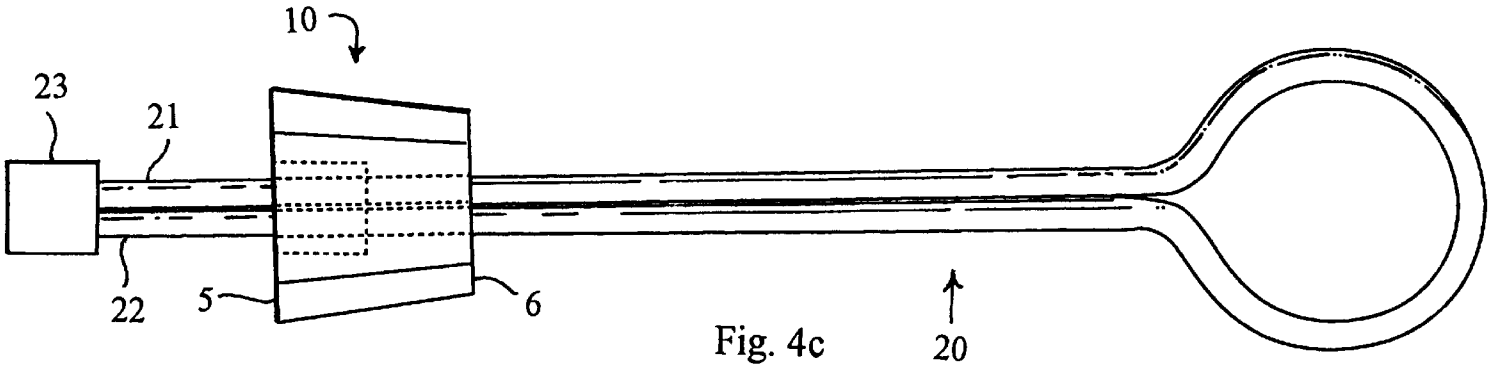
FIG. 4*c* shows as side view of the configuration of the second, with the insert not pressed into the body of the present invention.

As is apparent in FIG. 1, mountain climbing chocks are well known in the prior art. Though there is a variety of different chocks to choose from, each with its own particular improvements and benefits, there is still a need for new and useful improvements in the field. There is especially a need for a climbing chock with more that two useful vertical orientations. Furthermore, there is a need for a set of climbing chocks which provides a graduated series of widths such that each single chock of the set contains three descending chock wedge widths for use, while the next smaller chock contains three smaller chock wedge widths, etc. A graduated set of chock wedge widths, such as just described, would prove extremely useful while a climber is hanging on a rock face and simultaneously searching for a chock to fit into a desired crack.

The chocks of the present invention satisfy the above needs, and more, by providing for three different vertical useful orientations, each with a different wedge width. The widths of the three different orientations are scaled to provide a series of descending widths in a single chock. Small descending widths are then provided by producing a next smaller chock, and so on, to provide chocks with a complete set of descending wedge widths.

The chock of the present invention comprises a chock body 10 with a truncated prismatoid shape and is adapted to be used with an attached rope or cable 20.

The truncated prismatoid body 10 has a first larger irregular hexagonal base 5 and a second smaller irregular hexagonal base 6. Each irregular hexagonal shape of the first base 5 and the second base 6 is comprised of six sides, three sets of substantially parallel opposed sides. Since the first base 5 and the second base 6 differ only in size and not configuration, description of the first base 5 is sufficient to enable the second base 6. In each of said first base 5 and second base 6 there is a first side 11, a second side 12, a third side 13, a fourth side 14, a fifth side 15 and a sixth side 16. The first side 11 and the second side 12 intersect to form a first vertex a, the second side 12 and the third side 13 intersect to form a second vertex b, the third side 13 and the fourth side 14 intersect to form a third vertex c, the fourth side 14 and the fifth side 15 intersect to form a fourth vertex d, the fifth side 15 and the sixth side 16 intersect to form a fifth vertex e, and the sixth side 16 and the first side 11 intersect to form a sixth vertex f. Opposed sides, such as first side 11—fourth side 14; second side 12—fifth side 15; and third side 13—sixth side 16, are generally parallel to each other. The six sides have four different lengths. The first side 11 is the shortest side, the third side 13 and fourth side 14, both approximately the same length, have the next largest length, the fifth side 15 and sixth side 16, both approximately the same length, have the third largest length, while the second side 12 has the largest length. The special configuration of the present invention provides three different distances between opposed sides. Thus the distance between the first side 11 and the fourth side 14 is longest; the distance between the third side 13 and the sixth side 16 is shorter; and the distance between the second side 12 and the fifth side 15 is the shortest.

There are six generally trapezoidally shaped walls 7 which extend from corresponding sides of the first base 5 to the second base 6 to complete the truncated prismatoid body 10. The difference in size between the first base 5 relative to the second base 6, coupled with the distance between the two bases, is determinative of the wedge angle created by opposed walls 7 of the truncated prismatoid body 10. Preferably the included angle between opposed walls 7 of the truncated prismatoid body 10 is approximately 10 degrees.

The truncated prismatiod body 10 of the present invention is further provided with at least one passageway for receiving the rope or cable 20. Preferably, for smaller chocks, there are two substantially parallel passageways 30 extending between the first base 5 and the second base 6 for a double cabling system. The each of the two passageways 30 is adapted and sized to receive an end of the rope or cable 20. Thus, a loop is formed when a first end 21 of the cable 20 is received by one of the two passageways 30 and a second end 22 of the cable 20 is received by the other passageway. The first and second ends 21 and 22 of the cable 20 are secured to the body 10 by normal means well known in the art.

Figure 5:
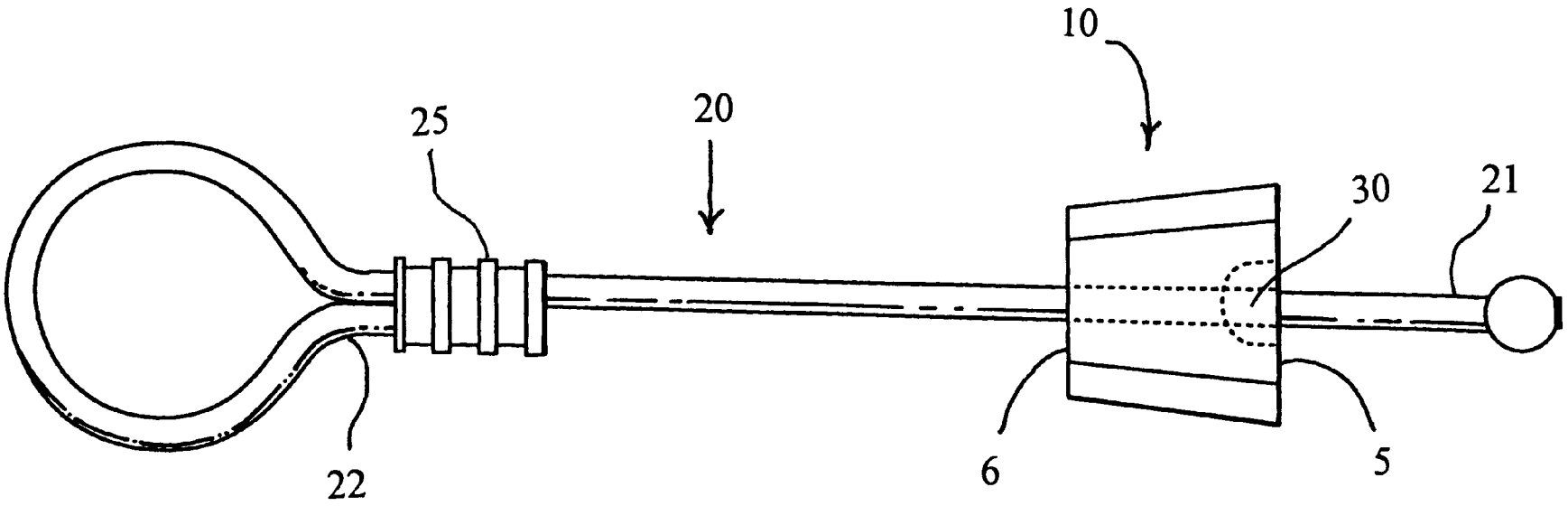
FIG. 5 illustrates a single cable embodiment of the present invention.

In a single cabling embodiment, there would only be a single passageway 30 for the first end 21 of the cable 20, while the second end 22 is then fastened by a ferule 25 to itself, as is illustrated in FIG. 5.

For larger chocks, there is a primary chamber 31 extending longitudinally between the first base 5 and a mid-point 8 of the truncated prismatoid body 10. There are two additional passageways 32 extending from the mid-point 8 of the truncated prismatoid body 10 and the second base 6. The primary chamber 31 and the two additional passageways 32 are in communication with each other such that when the first and second ends 21 and 22 of the cable 20 are inserted into the two additional passageways 32, they travel through the two additional passageways 32 and into the primary chamber 31. Preferably, the first and second ends 21 and 22 of the cable 20 are soldered into a cylindrical brass insert 23 and the insert 23 is then press fit into the primary chamber 31, thus securing the cable 20 to the body 10. Preferably, there is also a yoke 24 connected to the cable 20 to constrain portions of the cable 20 near the body 10 and to provide a more circular opening in the cable loop.

Figure 6:
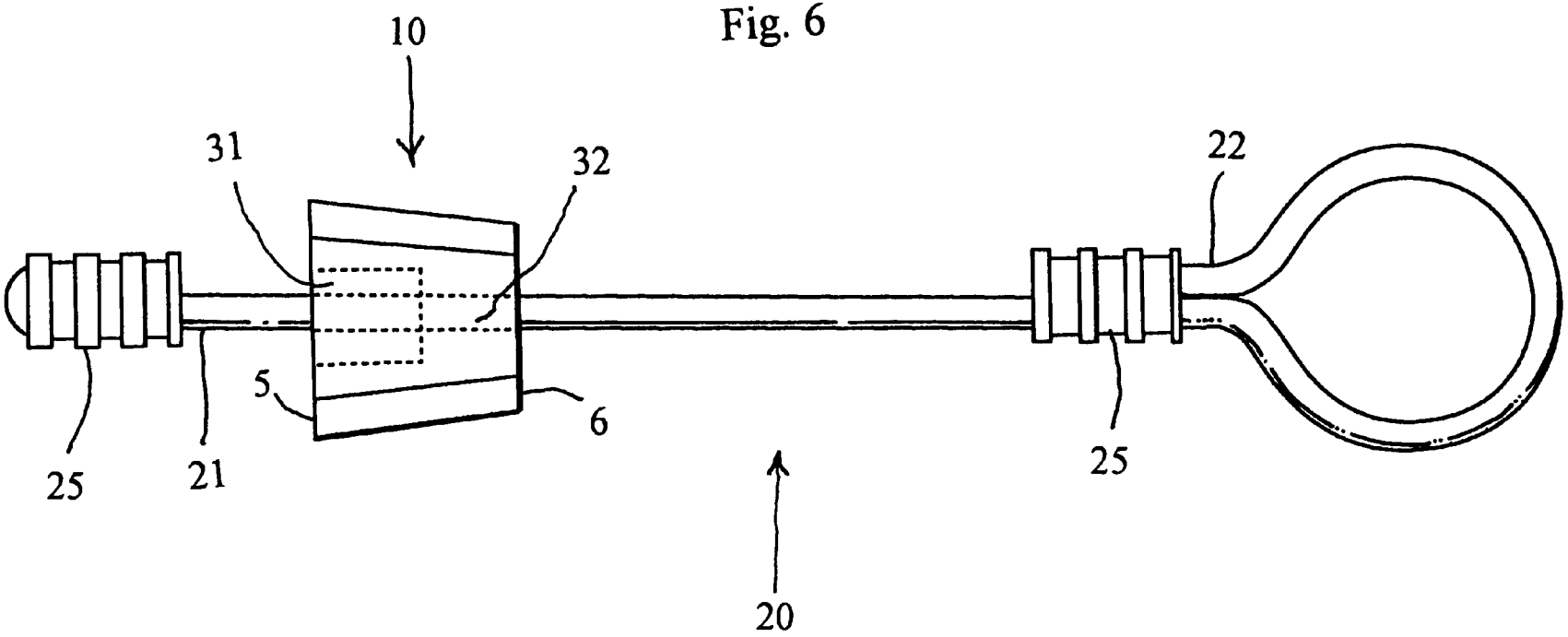
FIG. 6 illustrates an alternate single cable embodiment of the present invention.

There is a single cable embodiment of the present invention, shown in FIG. 6., wherein the prismatoid body 10 has a primary chamber 31 in communication with a single additional passageway 32. The first end 21 of the cable 20 is threaded though the passageway 32 and primary chamber 31, a ferule 25 is attached to the first end 21 and the assembly is pressed into the primary chamber 31. The second end 22 of the cable 20 is doubled back onto itself and attached with another ferule 25.

Figure 7:
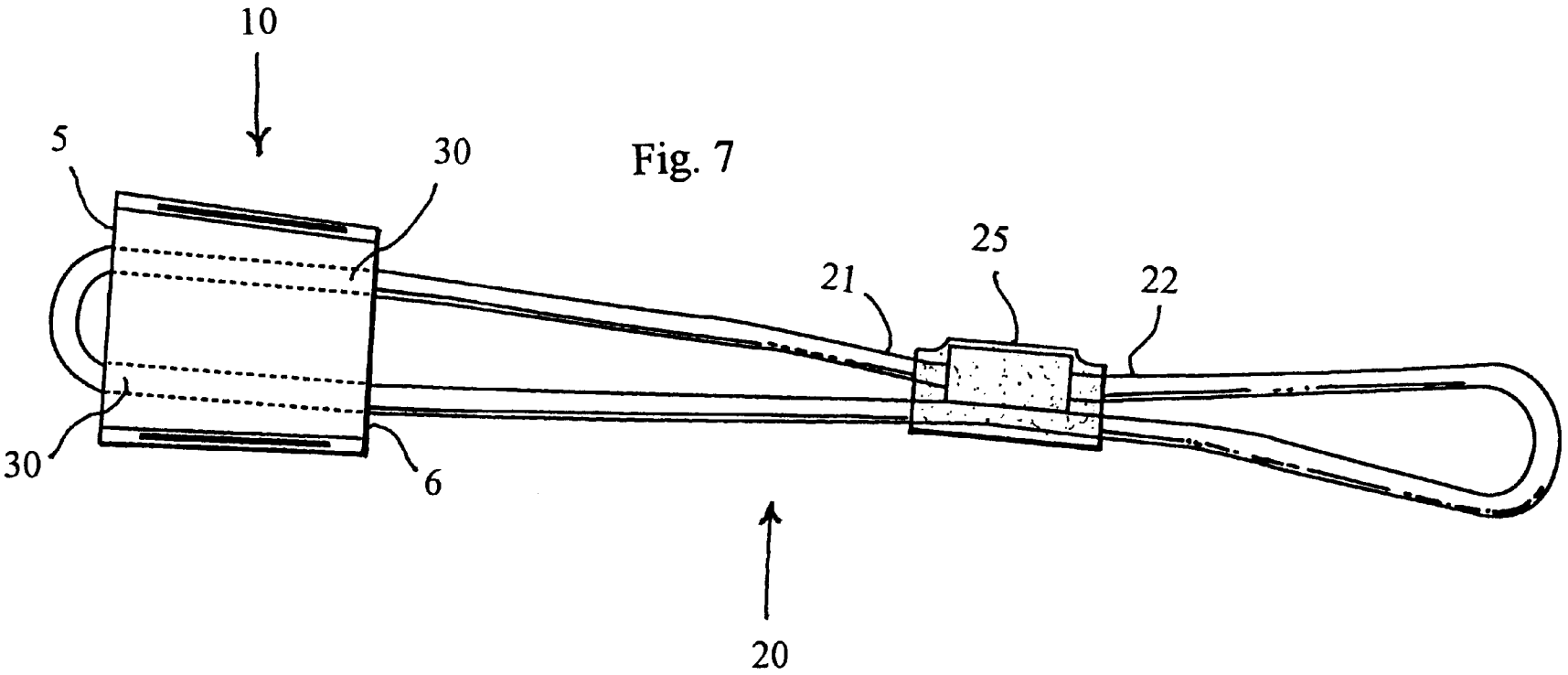
FIG. 7 illustrates an alternate double cable embodiment.

An alternate embodiment of the double cabling is shown in FIG. 7. In this embodiment there are two cable passageways 30 through which the cable 20 is threaded. The first end 21 of the cable 20 is threaded through both passageways 30 and placed near the second end 22 of the cable 20. The two ends of the cable 20 are then secured to the mid-point by means such as a ferule 25.

In use, the chock of this invention is inserted into a crack in a vertical orientation. Preferably, the second base 6 is lower than the first base 5 and the cable 20 depends from the second base 6. The chock is pulled down until two opposed walls of the chock wedge against opposite rock faces of the crack.

Since cracks have different widths, the present invention provides for selection of three consecutively smaller wedge widths by simple vertical rotation of the chock. Additionally, smaller chock wedge widths are accessible by simply choosing the next smaller sized chock in the set. It is important to note that previous devices in the field have only provided an intermixed set of descending widths. That is, climber using rectangular chocks would need at least two separate rectangular chocks to produce a descending wedge scale, e.g. one chock has the largest wedge width and the third largest wedge width, while the other chock has the second largest wedge width and the fourth largest wedge width, etc. It is therefore easy to see that the climber would have to exchange chock in order to produce descending wedge widths. The present invention provides for a set of chocks in which a first chock has the first, second and third largest wedge widths, a second chock has the fourth, fifth and sixth largest wedge widths, etc. Thus, the climber need only locate a chock close in size to the crack and fine tune the wedge fit by a simple vertical rotation of the chock of the present invention.

While these descriptions directly describe the above embodiments, it is understood that those skilled in the art may conceive modifications and/or variations to the specific embodiments shown and described herein. Any such modifications or variations which fall within the purview of this description are intended to be included therein as well. It is understood that the description herein in intended to be illustrative only and is not intended to be limitative. Rather, the scope of the invention described herein is limited only by the claims appended hereto.

What is claimed is:

1. A mountaineering stopper comprised of a prismatoid body having a first skewed hexagonal base, a second skewed hexagonal base substantially parallel to the first skewed hexagonal base, and six lateral trapezoidal faces, each with one side lying in the first skewed hexagonal base and an opposite side on each trapezoidal face lying in the second skewed hexagonal base; and a cable with a first end and a second end; attached to the prismatoid body and wherein at least one of the cable ends are attached to the prismatoid body.

2. A mountaineering stopper as in claim 1 wherein the at least one passageway is a single passageway with the first end of the cable being received with in the single passageway.

3. A mountaineering stopper as in claim 2 wherein the second end of the cable is doubled back onto itself and secured with a ferule.

4. A mountaineering stopper as in claim 1 wherein the at least one passageway is a pair of passageways where each passageway receives an end of the cable, respectively.

5. A mountaineering stopper as in claim 4 further having a portion of each of said first end and second end projecting beyond the first hexagonal base; furthermore the projecting portions of said first and second ends are attached together.

6. A mountaineering stopper as in claim 1 wherein the at least one passage way is a pair of passageways, where the first end of the cable is threaded through a first passageway, then through a second passageway and brought near the second end of the cable, both first end and second end then being secured to a mid-point of the cable by a ferule.

7. A mountaineering stopper comprised of a prismatoid body having a first skewed hexagonal base, a second skewed hexagonal base substantially parallel to the first skewed hexagonal base, and six lateral trapezoidal faces, each with one side lying in the first skewed hexagonal base and an opposite side on each trapezoidal face lying in the second skewed hexagonal base; a primary chamber adjacent the first skewed hexagonal base, at least one passageway adjacent to the second skewed base and in communication with the primary chamber, and a cable with a first end and a second end, wherein at least the first end is received by the at least one passageway and primary chamber.

8. A mountaineering stopper as in claim 7 wherein the at least one passageway is a single passageway with the first end of the cable being received within the single passageway and primary chamber.

9. A mountaineering stopper as in claim 8 wherein the first end of the cable has an attached ferule which is capable of being press fit into the primary chamber.

10. A mountaineering stopper as in claim 7 wherein the at least one passageway is a pair of passageway where each passageway receives an end of the cable, respectively.

11. A mountaineering stopper as in claim 10 wherein the at least one passageway is a pair of passageway where each passageway receives an end of the cable, respectively, wherein the first and second ends of the cable are further attached to an insert capable of being press fit into the primary chamber.

12. A mountaineering stopper comprised of a prismatoid body having a first skewed hexagonal base, a second skewed hexagonal base substantially parallel to the first skewed hexagonal base, and six lateral trapezoidal faces forming three opposed pairs of faces, each face with one side lying in the first skewed hexagonal base and an opposite side on each trapezoidal face lying in the second skewed hexagonal base, where lengths of the sides of the skewed hexagonal base substantially obey the following relationship: a first side has a length, a fourth side opposite the first side is slightly larger than the first side, a third side, immediately adjacent to the fourth side, is the same length as the second side, a sixth side, opposite the third side and adjacent the first side is slightly longer than the third and fourth sides, a fifth side, immediately adjacent the sixth side is the same length as the sixth side, and a second side, opposite the fifth side and adjacent the first and third sides, is longer than the fifth and sixth sides; a cable with a first end and a second end; and at least one passageway in the prismatoid body connecting the first skewed hexagonal base to the second skewed hexagonal base and wherein at least one of the cable ends are received within said passageway.

13. A mountaineering stopper as in claim 12 wherein the at least one passageway is a single passageway with the first end of the cable being received with in the single passageway.

14. A mountaineering stopper as in claim 13 wherein the second end of the cable is doubled back onto itself and secured with a ferule.

15. A mountaineering stopper as in claim 12 wherein the at least one passageway is a pair of passageways where each passageway receives an end of the cable, respectively.

16. A mountaineering stopper as in claim 15 further having a portion of each of said first end and second end projecting beyond the first hexagonal base; furthermore the projecting portions of said first and second ends are attached together.

17. A mountaineering stopper as in claim 12 wherein the at least one passageway is a pair of passageways, where the first end of the cable is threaded through a first passageway, then through a second passageway and brought near the second end of the cable, both first end and second end then being secured to a mid-point of the cable by a ferule.

* * * * *